US008555909B2

(12) United States Patent
Chen

(10) Patent No.: US 8,555,909 B2
(45) Date of Patent: Oct. 15, 2013

(54) TENT

(75) Inventor: Jack Chen, New Taipei (TW)

(73) Assignee: Sportsman Corporation, New Taipei (TW)

( * ) Notice: Subject to any disclaimer, the term of this patent is extended or adjusted under 35 U.S.C. 154(b) by 98 days.

(21) Appl. No.: 13/242,015

(22) Filed: Sep. 23, 2011

(65) Prior Publication Data

US 2013/0032187 A1 Feb. 7, 2013

(30) Foreign Application Priority Data

Aug. 3, 2011 (TW) ..... 100127489 A

(51) Int. Cl.
*E04H 15/44* (2006.01)

(52) U.S. Cl.
USPC ..... 135/130; 135/88.04; 135/133

(58) Field of Classification Search
USPC ..... 135/88.04, 120.2, 130, 132, 133, 909; 403/93
See application file for complete search history.

(56) References Cited

U.S. PATENT DOCUMENTS

| | | | | | |
|---|---|---|---|---|---|
| 1,696,245 | A | * | 12/1928 | Manly | 5/314.1 |
| 1,855,857 | A | * | 4/1932 | Harman | 403/65 |
| 2,159,309 | A | * | 5/1939 | Betourne | 135/130 |
| 2,752,929 | A | * | 7/1956 | Berger | 297/31 |
| 3,171,417 | A | * | 3/1965 | Stokes | 135/132 |
| 3,242,935 | A | * | 3/1966 | Williams | 135/132 |
| 4,402,544 | A | * | 9/1983 | Artim et al. | 296/110 |
| 4,748,995 | A | * | 6/1988 | Viglione | 135/130 |
| 5,159,947 | A | * | 11/1992 | Chuang et al. | 135/132 |
| 5,520,141 | A | * | 5/1996 | Lutz | 116/173 |
| 7,604,016 | B2 | * | 10/2009 | Songest | 135/132 |
| 7,640,942 | B2 | * | 1/2010 | Chu | 135/132 |
| 8,360,084 | B1 | * | 1/2013 | Robinson | 135/133 |

* cited by examiner

*Primary Examiner* — Noah Chandler Hawk
(74) *Attorney, Agent, or Firm* — C. G. Mersereau; Nikolai & Mersereau, P.A.

(57) ABSTRACT

A tent having two joints, multiple frames and a fly. The frames are mounted on the joints and are classified into a stationary frame, a supporting frame and at least one pivoting frame. The frames cooperate to define a parking space for receiving a cycle when unfolding. The fly covers the frames and the parking space. The frames are capable of folding and overlapping one another to facilitate carrying and storage of the tent.

4 Claims, 14 Drawing Sheets

TENT

BACKGROUND OF THE INVENTION

1. Field of the Invention

The present invention relates to a tent, and more particularly to a tent that is convenient for use and storage.

2. Description of Related Art

More and more people enjoy riding cycles such as bicycles or motorcycles to relax and ease pressure. Some people spend more money on expensive cycles for higher performance and extraordinary style. These people also maintain their cycles periodically to keep the cycles in the best status.

However, the cycles parked and exposed outdoors suffer harm from the sun and rain and therefore components thereof easily get aged or rusty. Some users use a sheet of canvas to cover their cycles. However, conventional sheets of canvas are not designed exclusively for cycles and cannot completely cover the whole cycles.

To overcome the shortcomings, the present invention provides a tent to mitigate or obviate the aforementioned problems.

SUMMARY OF THE INVENTION

The main objective of the invention is to provide a tent that is convenient for use and storage.

A tent in accordance with the present invention comprises two joints, multiple frames and a fly. The frames are mounted on the joints and are classified into a stationary frame, a supporting frame and at least one pivoting frame. The frames cooperate to define a parking space for receiving a cycle when unfolding. The fly covers the frames and the parking space. The frames are capable of folding and overlapping one another to facilitate carrying and storage of the tent.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
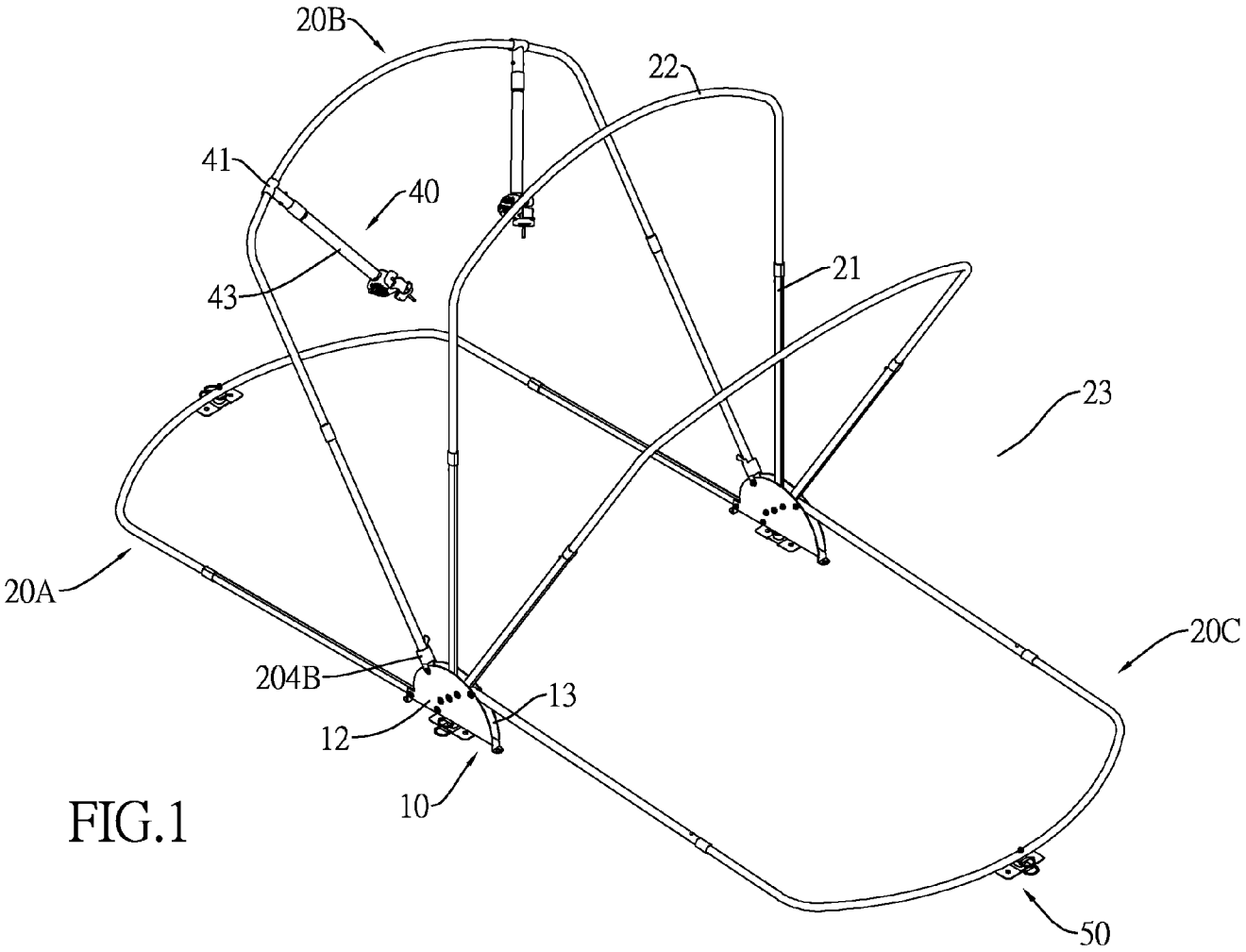
FIG. 1 is a perspective view of a tent in accordance with the present application omitting a fly.
Figure 2:
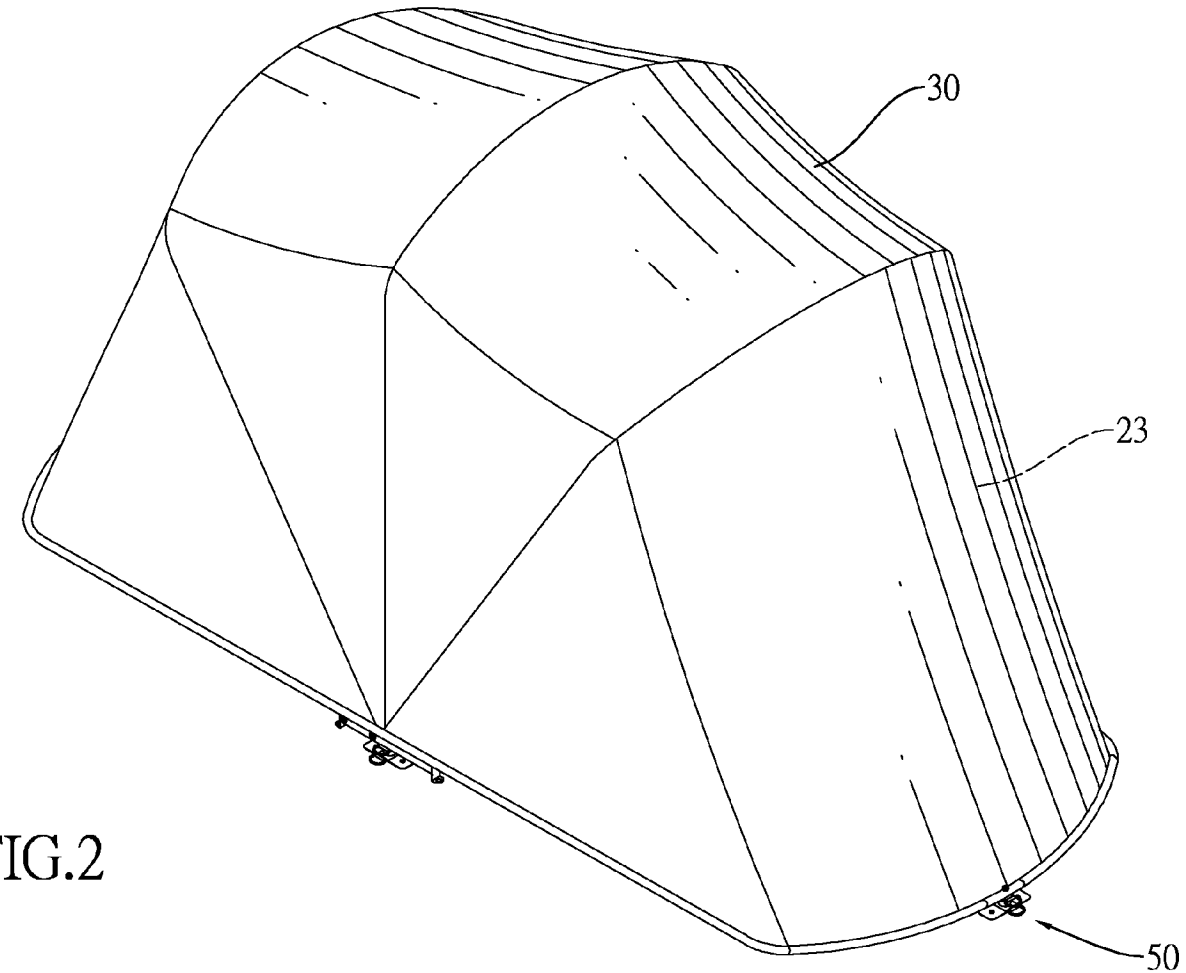
FIG. 2 is a perspective view of the tent in FIG. 1 with the fly.

With reference to FIGS. 1 and 2, a tent in accordance with the present invention comprises two joints 10, multiple frames, a fly 30, at least one clamp assembly 40 and four loop assemblies 50.

Figure 3:
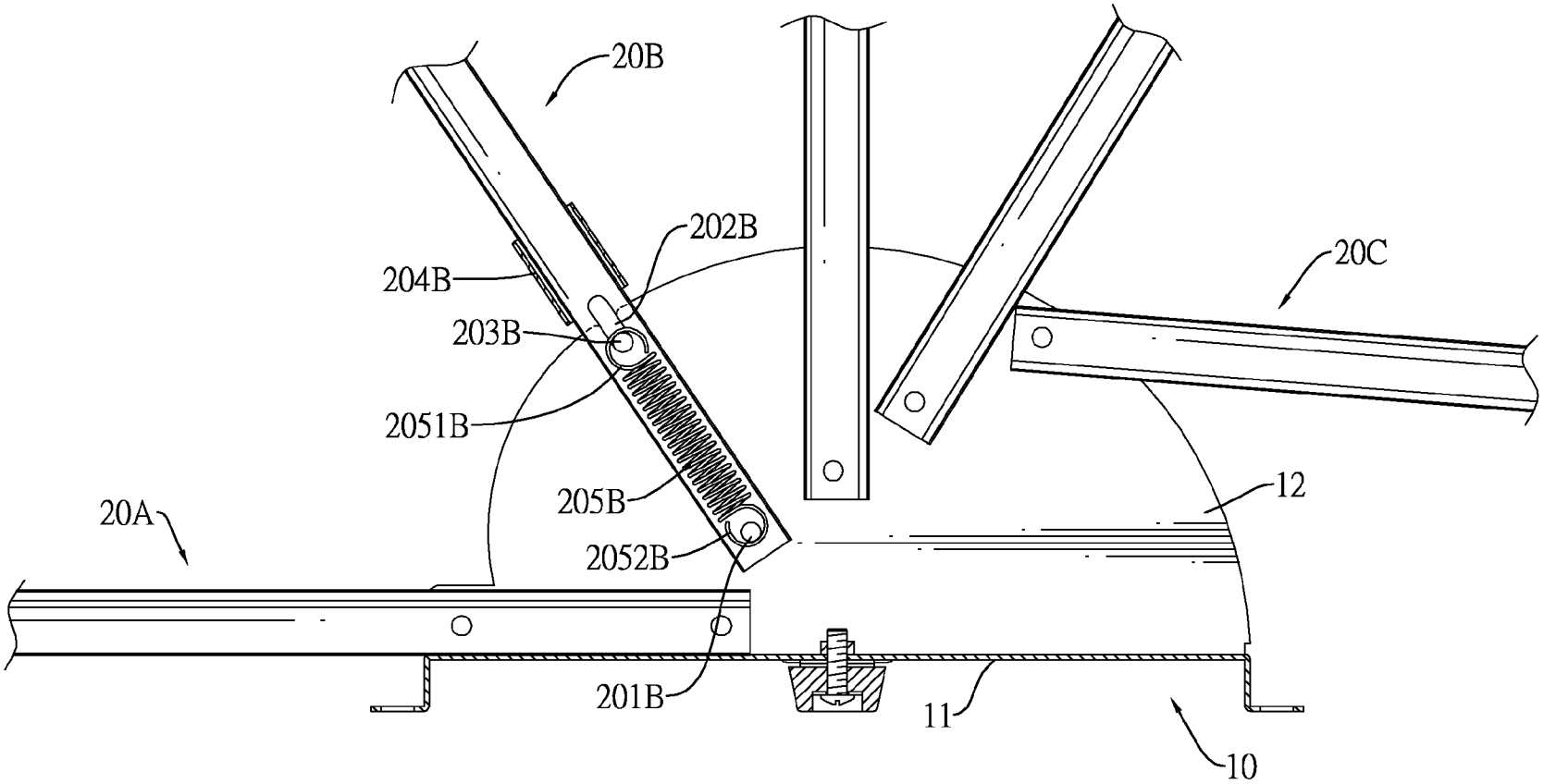
FIG. 3 is an enlarged cross sectional side view of the tent in FIG. 1.

With reference to FIGS. 1 and 3, the joints 10 are formed from sheet metals by bending or stamping processes. Each joint 10 has a bottom plate 11, two opposite wings 12, an assembling slot 13 and two positioning slots 14.

The wings 12 are formed on and protrude from the bottom plate 11 and each wing 12 has an outer edge that may be convex. The assembling slot 13 is defined between the wings 12. The positioning slots 14 are formed respectively on the outer edges of the wings 12.

The frames are U-shaped and hollow, may be classified into a stationary frame 20A, a supporting frame 20B and at least one pivoting frame 20C.

The stationary frame 20A parallels the bottom plates 11 of the joints 10 and the ground and has two mounting ends mounted respectively in the assembling slots 13 of the joints 10.

The supporting frame 20B is located near the stationary frame 20A and has an axial hole and two pivoting ends. The axial hole is defined in the supporting frame 20B. The pivoting ends are pivotally mounted respectively in the assembling slots 13 of the joints 10 and each pivoting end has two pivot pins 201B, two elongated slots 202B, a locking pin 203B, a lock release 204B and a spring 205B.

Figure 4:
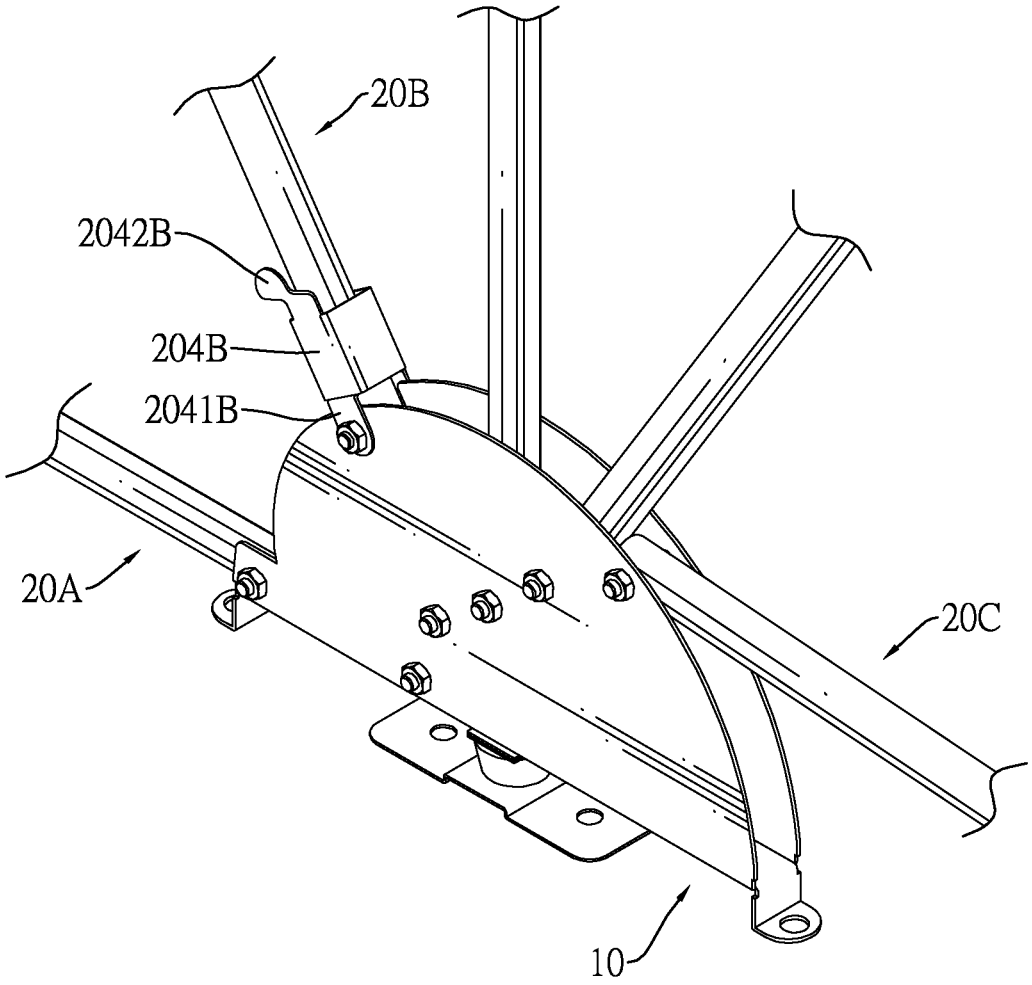
FIG. 4 is an enlarged perspective view of the tent in FIG. 1.

The pivot pin 201B is mounted through the pivoting end of the supporting frame 20B and extends through the wings 12 of one joint 10. The elongated slots 202B are diametrically opposed, are defined radially through the supporting frame 20B near the pivoting end and communicate with the axial hole. The locking pin 203B is mounted slidably through the elongated slots 202B and selectively engages the positioning slots 14 of one joint 10, as shown in FIG. 4. The lock release 204B is mounted slidably around the supporting frame 20B over the elongated slots 202B, is connected to the locking pin 203B and has two connecting tabs 2041B and a handling tab 2042B. The connecting tabs 2041B are formed on and protrude from the lock release 204B and are connected to the locking pin 203B. The handling tab 2042B is formed on and protrudes from the lock release 204B. The spring 205B is mounted between the pivot pin 201B and the locking pin 203B and has two hooks 2051B, 2052B hooking respectively on the locking pin 203B and the pivot pin 201B.

Figure 5:
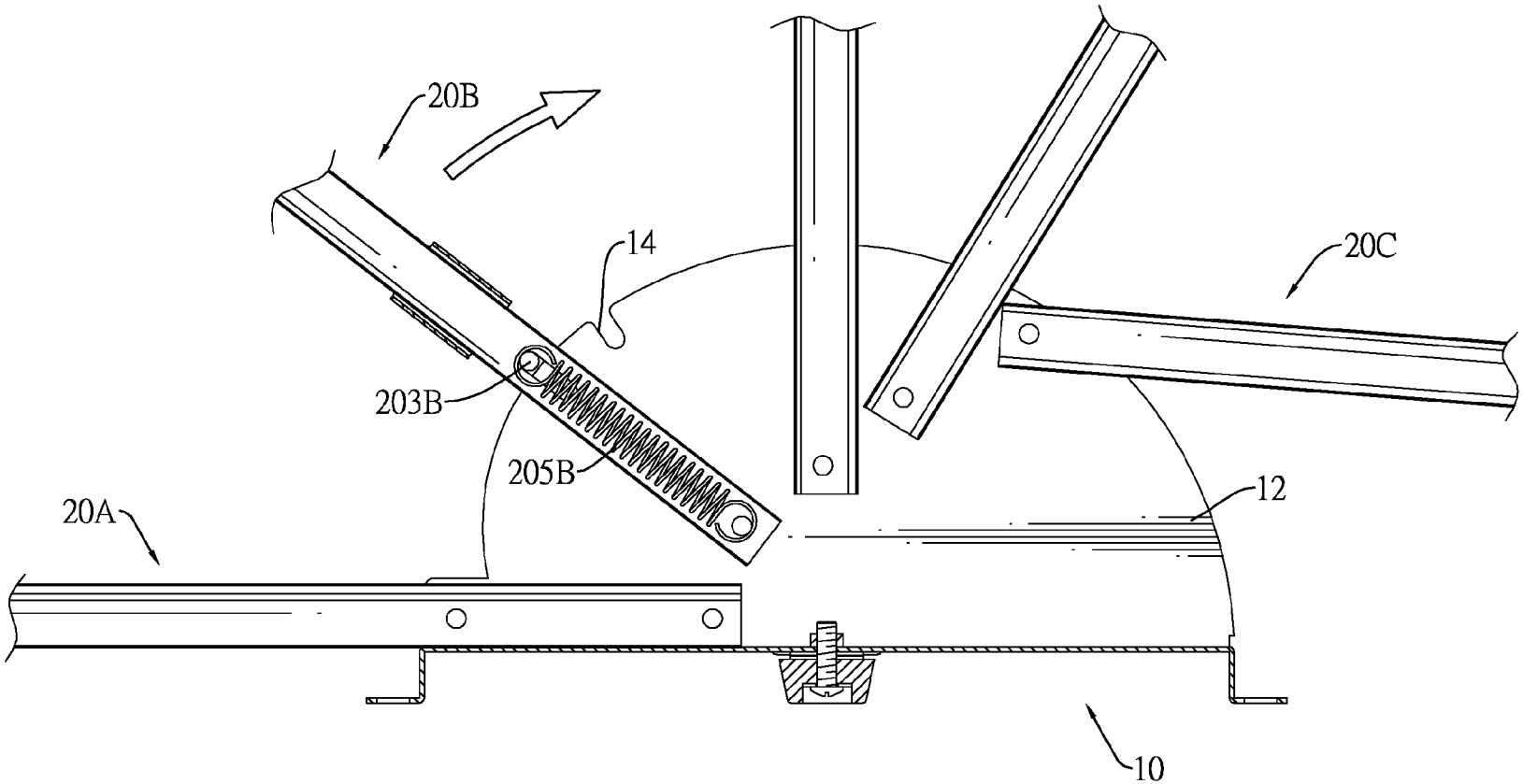
FIG. 5 is an operational enlarged cross sectional side view of the tent in FIG. 3.

With reference to FIG. 5, the supporting frame 20B is capable of pivoting relative to the joints 10. When the supporting frame 20B pivots up away from the stationary frame 20A, each locking pin 203B is located on top ends of the elongated slots 202B in one pivot end and slides along the outer edges of the wings 12 of one joint 10. At the same time, the spring 205B is stretched and stores resilient force. With reference to FIG. 3, when the locking pin 203B moves to the positioning slots 14 of the joint 10, the resilient force of the spring 205B engages the locking pin 203B with the positioning slots 14 and holds the supporting frame 20B at a specific angle relative to the joints 10. Manually pulling the handling tab 2042B of the lock release 204B disengages the locking pins 203B from the elongated slots 202B so that the supporting frame 20B is allowed to pivot relative to the joints 10.

Figure 6:
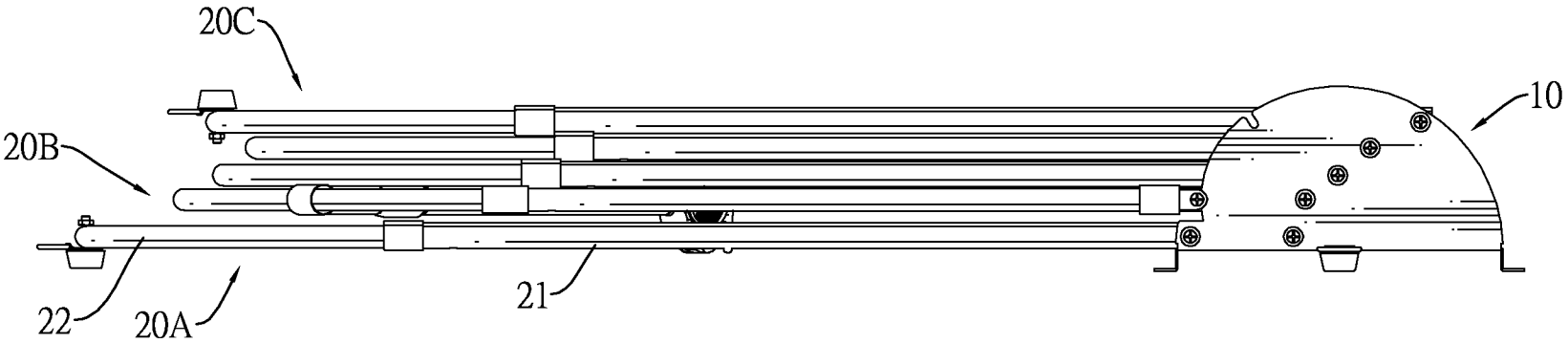
FIG. 6 is an operational side view of the tent in FIG. 1 showing that the tent is folded into a compact configuration.

With reference to FIG. 1, the at least one pivoting frame 20C has two connecting ends pivotally mounted respectively in the assembling slots 13 of the joints 10. In a preferred embodiment, three pivoting frames 20C are implemented. The supporting frame 20B and pivoting frames 20C pivot away from the stationary frame 20A at intervals and one pivoting frame 20C being farthest away from the supporting frame 20B contacts the ground so that a parking space 23 is formed between the stationary frame 20A, supporting frame 20B and pivoting frames 20C, as shown in FIG. 6. In summary, the parking space 23 is formed when the frames unfold. The pair of the mounting ends of the stationary frame 20A, the pair of the pivoting ends of the supporting frame 20B and the pairs of the connecting ends of the pivoting frames 20C are located at different levels relative to the joints 10, may be located by one over another in turn so that when all frames are folded, the pivoting frames 20C and supporting frame 20B parallel and overlap on the stationary frame 20A.

With reference to FIG. 1, each of the stationary frame 20A, the supporting frame 20B and the at least one pivoting frame 20C may be a telescopic configuration and further has two extension tubes 21 and a U-shaped tube 22.

Figure 7:
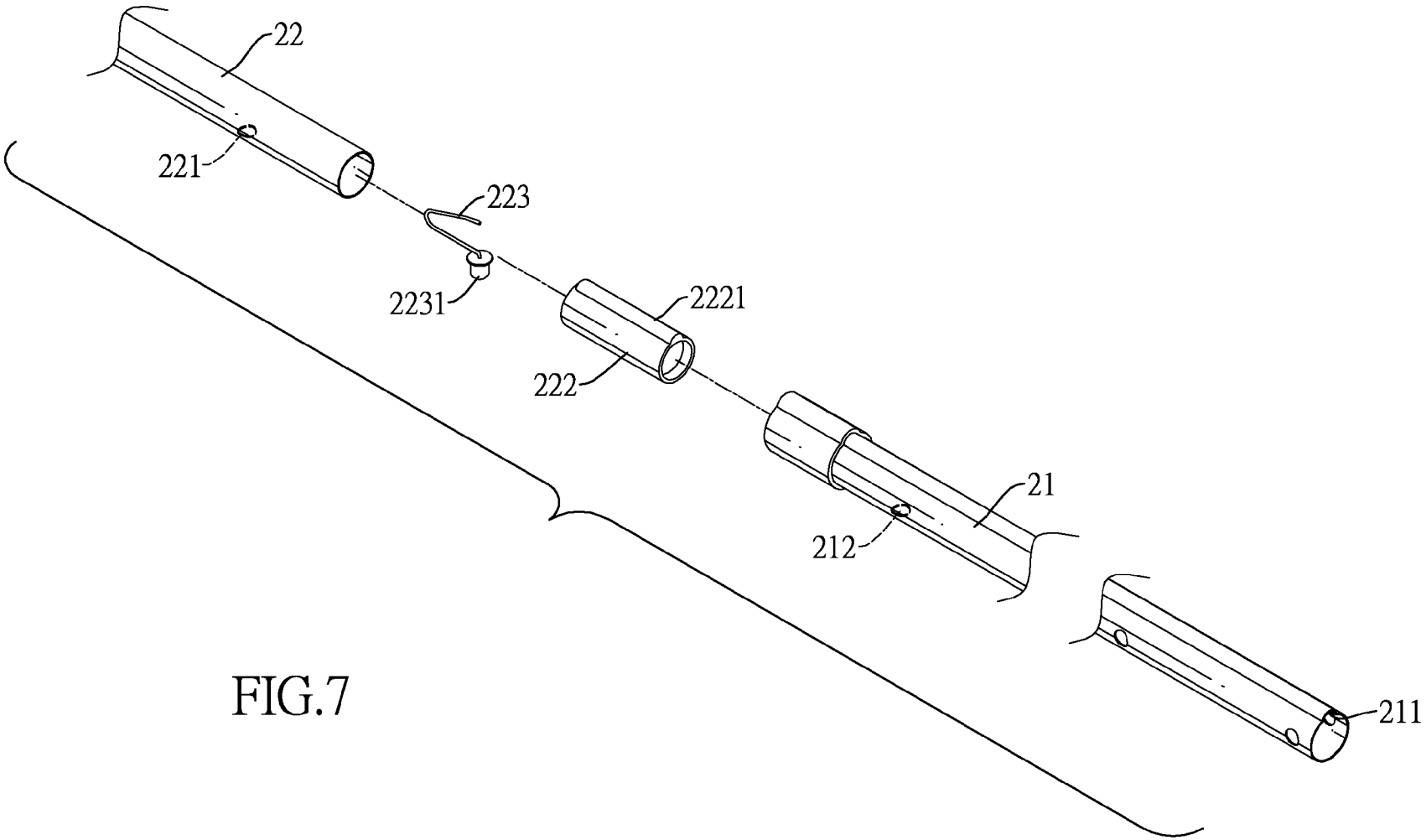
FIG. 7 is an exploded perspective view of the telescopic assembly of each frame of the tent in FIG. 1.
Figure 8:
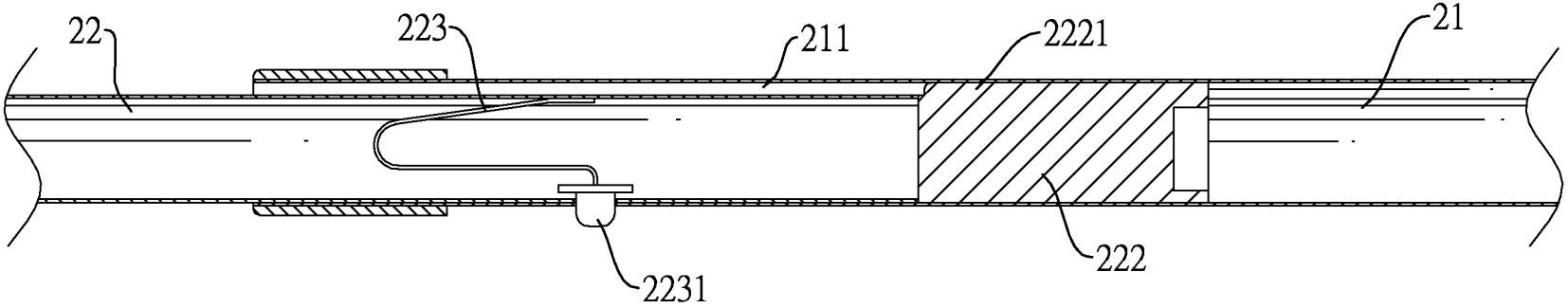
FIG. 8 is a cross sectional side view of the telescopic assembly of the tent in FIG. 7.

With reference to FIGS. 7 and 8, each extension tube 21 is hollow and has a through hole, a guide slot 211 and multiple positioning bores 212. The through hole is defined axially in the extension tube 21. The guide slot 211 is defined radially in the extension tube 21 and communicates with the through hole. The positioning bores 212 are defined radially through the extension tube 21 and arranged longitudinally.

The U-shaped tube 22 is hollow and has two ends, two transverse bores 221, two guides 222 and two resilient elements 223. The transverse bores 221 are defined respectively through the ends of the U-shaped tube 22. The guides 222 are mounted respectively on the ends and are mounted respectively slidably in the through holes of the extension tubes 21. Each guide 222 has a guiding rib 2221 formed on and protruding radially on the guide 22 and mounted slidably in the guide slot 211 of one extension tube 21 to ensure that the U-shaped tube 22 stably slides on the extension tubes 21 without inadvertent rotation. The resilient elements 223 are mounted respectively in the ends of the U-shaped tube 22 and each resilient element 223 has a locking protrusion 2231 mounted on the resilient element 223, extending through the transverse bore 221 of one end of the U-shaped tube 22 and retractably extending through one positioning bore 212 of one extension tube 21. When the locking protrusion 2231 extends through the transverse bore 221 and the positioning bore 212, the extension tube 21 is positioned on the U-shaped tube 22. Pressing the locking protrusion 2231 into the U-shaped tube 22 allows the U-shaped tube 22 to retract partially in the extension tubes 21 for storage.

Figure 9:
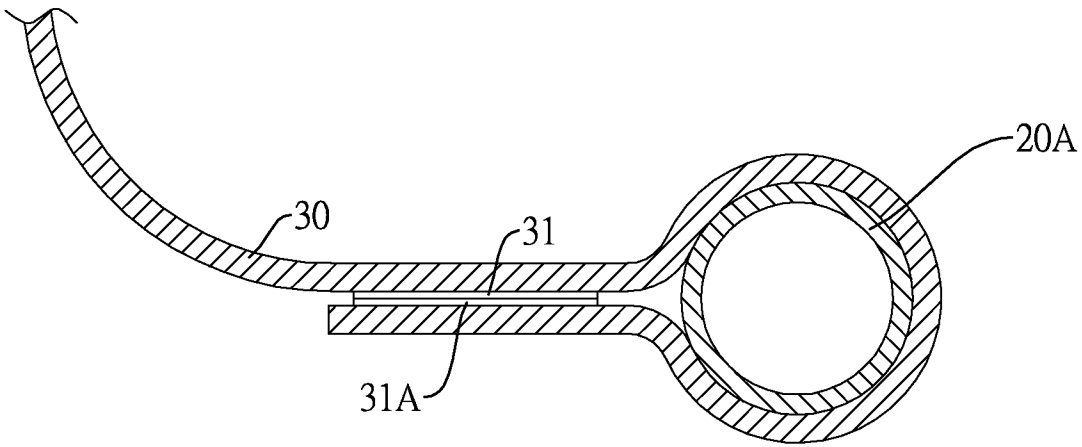
FIG. 9 is a cross sectional view of hook and loop fasteners of the fly mounted around one frame of the tent in FIG. 1.
Figure 10:
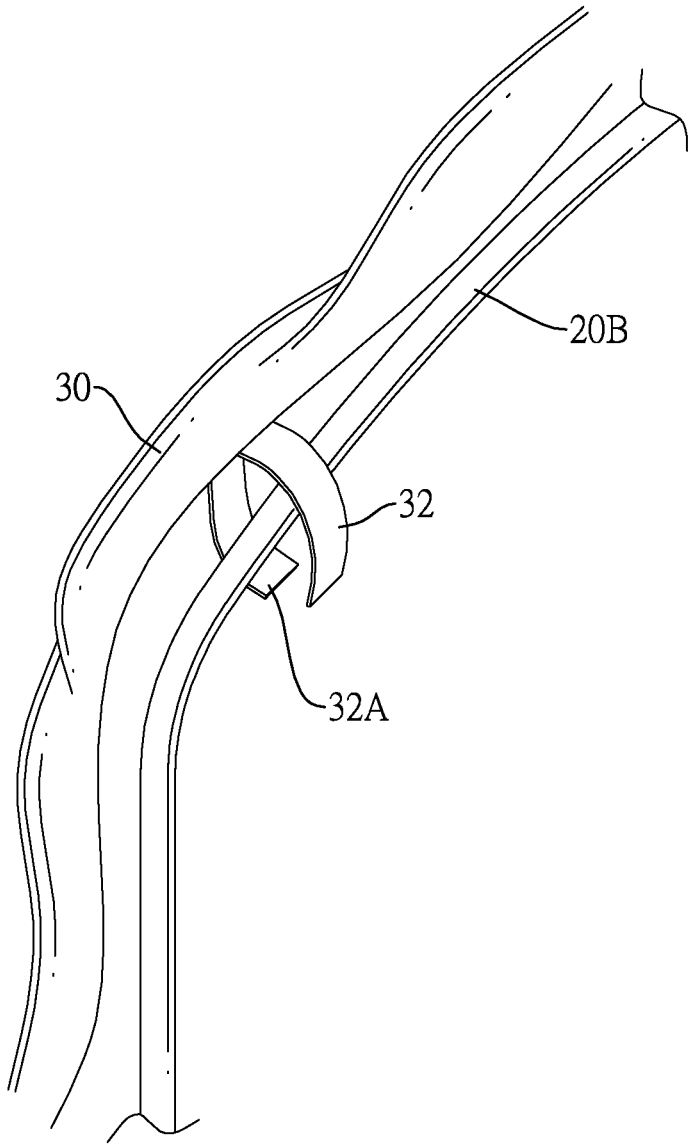
FIG. 10 is an operational perspective view of hook and loop fasteners of the fly mounted around one frame of the tent in FIG. 1.

With reference to FIGS. 2 and 9, the fly 30 covers the stationary frame 20A, the supporting frame 20B and the at least one pivoting frame 20C, encloses the parking space 23 and has an inner surface, two opposite end edges, two first fastening assemblies and multiple second fastening assemblies.

The end edges are mounted respectively to the stationary frame 20A and one pivoting frame 20C being farthest from the stationary frame 20C.

The first fastening assemblies are mounted respectively on the end edges of the fly 30 and each first fastening assembly has a first hook fastening member 31 and a first loop fastening member 31A attached to the end edge at an interval. Setting each end edge of the fly 30 around the stationary frame 20A or the pivoting frame 20B and engaging the first hook fastening member 31 and first loop fastening member 31A together securely mount the edge on the stationary frame 20A or the pivoting frame 20B.

The second fastening assemblies are mounted on the inner surface of the fly 30 and each second fastening assembly has a second hook fastening member 32 and a second loop fastening member 32A. The second hook fastening member 32 and the second loop fastening member 32A are mounted on the inner surface, are mounted around one of the pivoting frames 20C and engage each other to position the fly 30 on the pivoting frames 20C.

Figure 11:
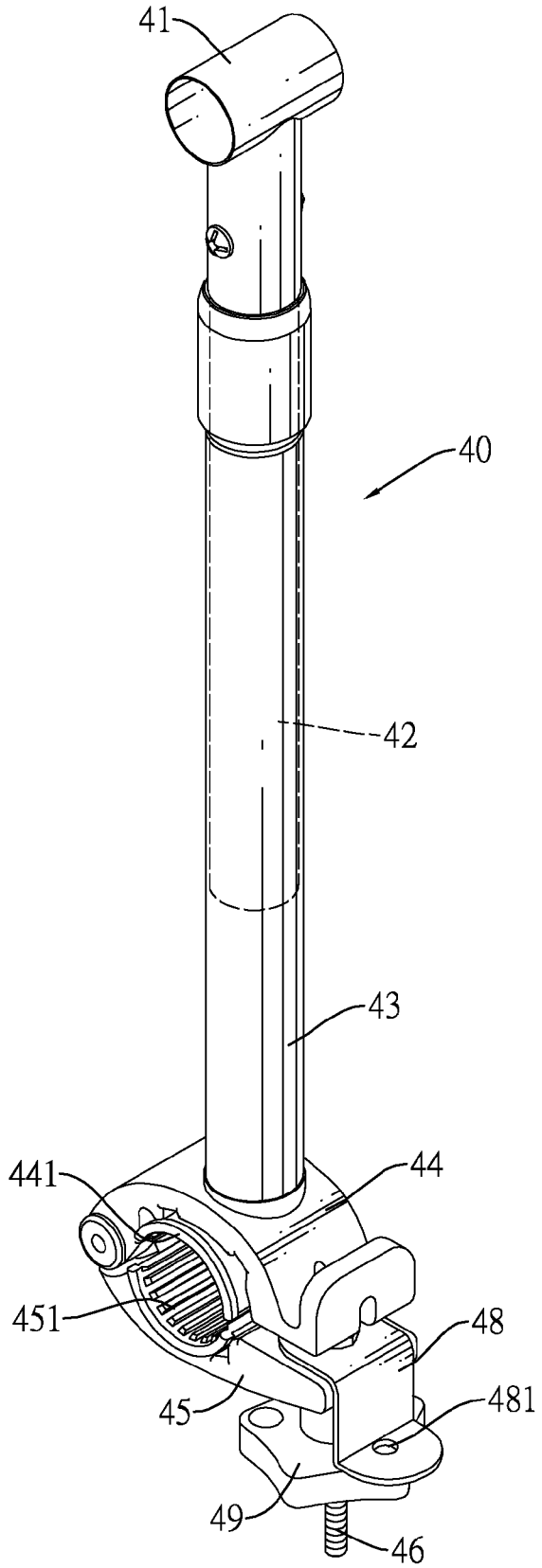
FIG. 11 is a perspective view of a clamp assembly of the tent in FIG. 1.
Figure 12:
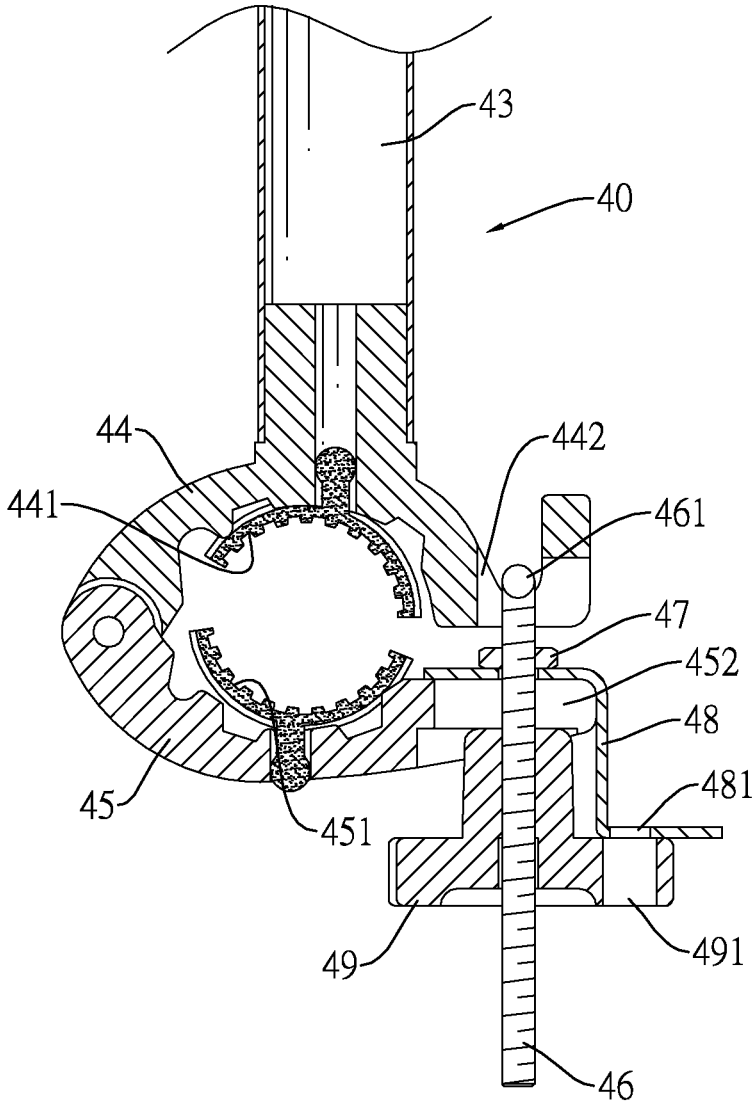
FIG. 12 an enlarged cross sectional side view of the clamp assembly of the tent in FIG. 11.

With reference to FIGS. 1 and 11, each of the at least one clamp assembly 40 has a sleeve 41, a telescopic bar and a clamp.

The sleeve 41 is mounted slidably around one of the stationary frame 20A, the supporting frame 20B and the at least one pivoting frame 20C.

The telescopic bar is mounted on the sleeve 41 and has an inner tube 42 and an outer tube 43. The inner tube 42 is mounted securely on the sleeve 41. The outer tube 43 is mounted slidably around the inner tube 42.

The clamp is mounted on the outer tube 43 and has a stationary clamping member 44, a pivoting clamping member 45, a bolt 46, a locking tab 48, a nut 47 and a knob 49.

The stationary clamping member 44 is mounted securely on the outer tube 43 and has a fastening hole 442 and an inside friction pad 441. The fastening hole 442 is defined through the stationary clamping member 44. The inside friction pad 441 is mounted on the stationary clamping member 44.

The pivoting clamping member 45 is mounted pivotally on and cooperates with the stationary clamping member 44 to clamp a handlebar of a cycle. Furthermore, a clamping hole is defined between the pivoting clamping member 45 and the stationary clamping member 44. The pivoting clamping member 45 has a fastening slot 452 and an inside friction pad 451. The fastening slot 452 is defined through the pivoting clamping member 45. The inside friction pad 451 is mounted on the pivoting clamping member 45.

The bolt 46 extends through the fastening hole 442 and the fastening slot 452 and has two ends and a stopper 461 formed on one end of the bolt 45 and abutting the stationary clamping member 44.

The locking tab 48 is mounted between the stationary clamping member 44 and the pivoting clamping member 45, is mounted around the bolt 46 and has a locking hole 481 defined through the locking tab 48.

The nut 47 is screwed on the bolt 46 and abuts the locking tab 48.

The knob 49 is screwed on the bolt 46, abuts the pivoting clamping member 45 and has a locking bore 491 defined through the knob 49 and corresponding to the locking hole 481 of the locking tab 48. Extending a shackle of a lock through the locking hole 481 and the locking bore 491 prevents the knob 49 from rotating and prohibits the clamp assembly from opening Therefore, the cycle is kept from being stolen.

Figure 13:
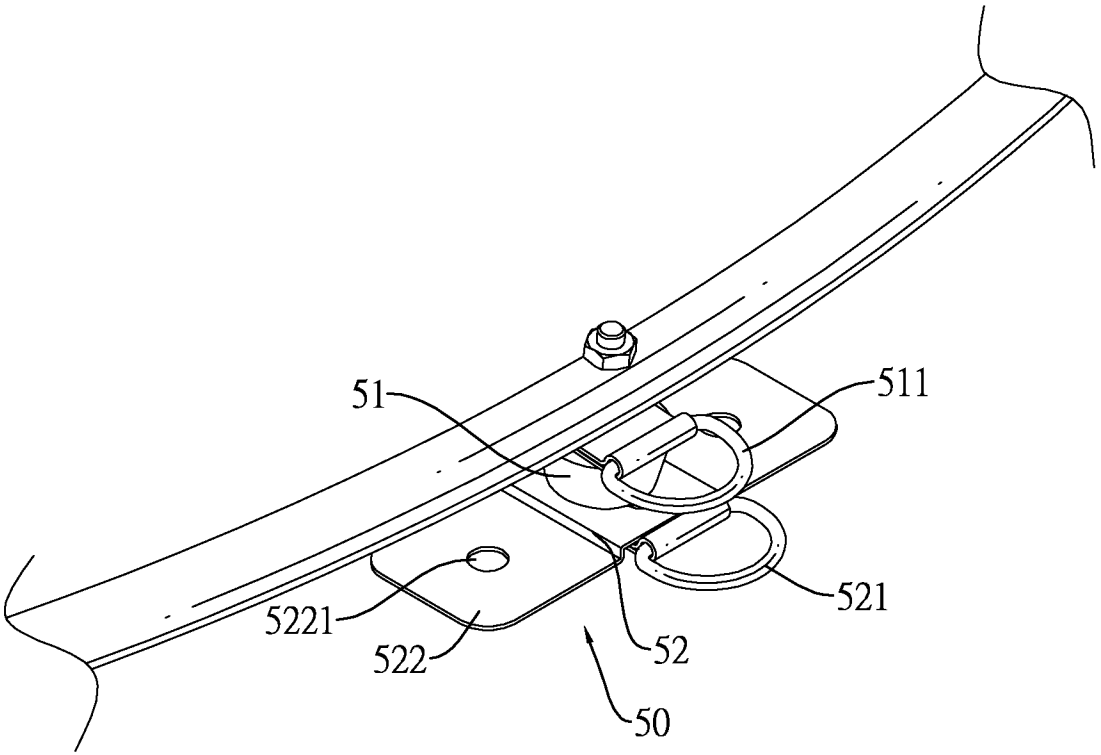
FIG. 13 is an enlarged perspective view of a loop assembly of the tent in accordance with the present invention.

With reference to FIG. 1, the loop assemblies 50 are mounted respectively on the bottom plates 11 of the joints 10, the stationary frame 20A and the pivoting frame 20C that is farthest away from the stationary frame 20A. With reference to FIG. 13, each loop assembly 50 has a cushion pad 51 and a board 52.

The cushion pad 51 is mounted securely on one of the bottom plates 11 of the joints 10, the stationary frame 20A and the pivoting frame 20C and has a first loop 511 mounted on the cushion pad 51.

The board 52 detachably contacts the cushion pad 51 and has two opposite side tabs 522 and a second loop 521. The side tabs 522 are formed on the board 52 and each side tab 522 has a fastening hole 5221 defined through the side tab 522 for a fastener such as a nail to extend through the fastening hole 5221 into the ground. The second loop 521 is mounted on the board 52 and spaced from the first loop 511. Mounting a stake through first loop 511 and the second loop 521 into the ground stably holds the tent on the ground. Furthermore, the board 52 may be secured on the ground and serves as a mark that facilitates always setting the tent on the same place.

Figure 14:
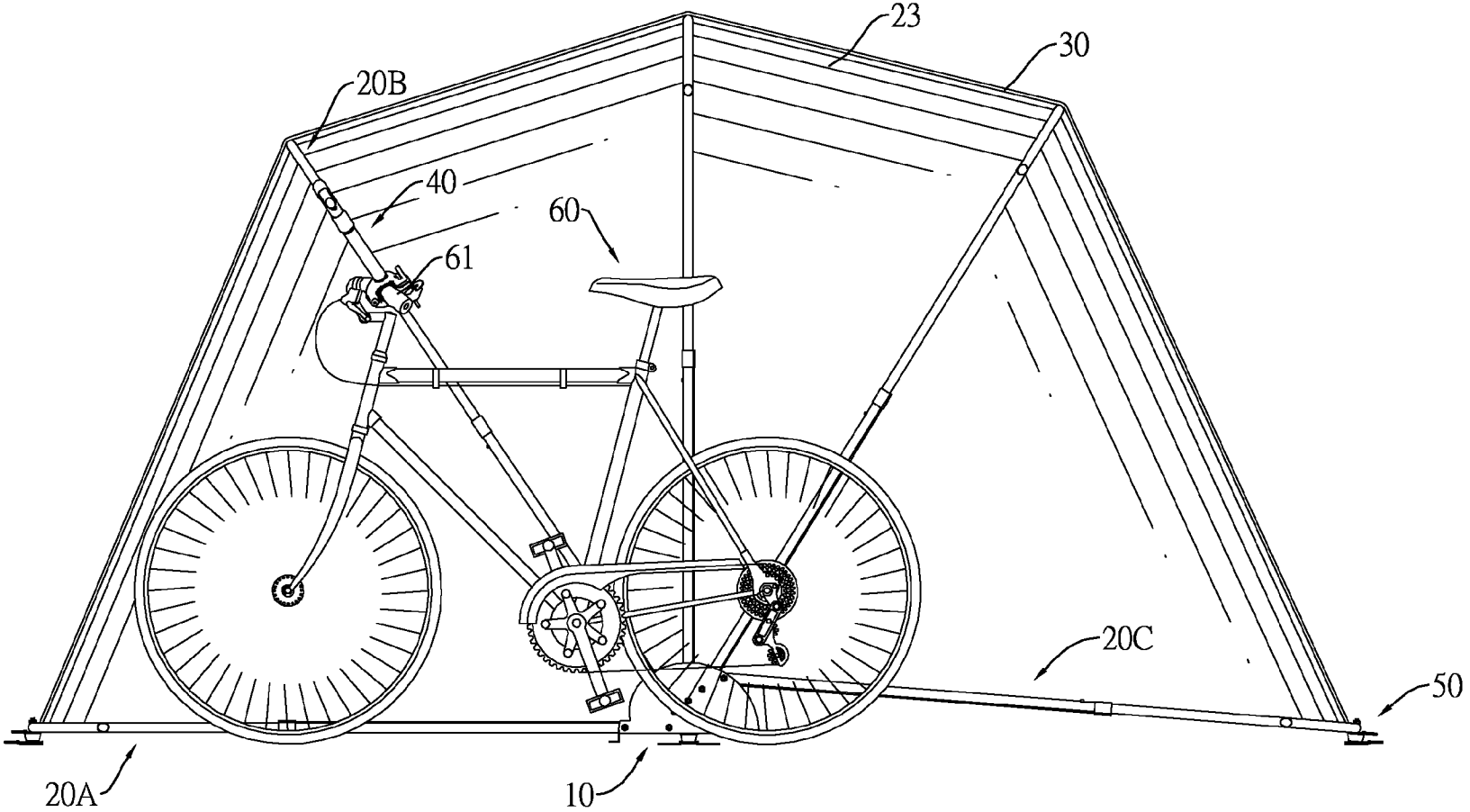
FIG. 14 is an operational cross sectional side view of the tent in FIG. 2 sheltering a bicycle.

With reference to FIG. 14, a bicycle 60 may be parked in the parking space 23 of the tent to prevent the bicycle 60 from suffering harm of the sun and rain. The clamp assembly 40 keeps the bicycle 60 from toppling. When a user needs to ride the bicycle 60, the farthest pivoting frame 20C pivots up with the stakes thereon removed to form an entrance that allows the user to access the bicycle 60.

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A tent comprising:

two joints and each joint having an assembling slot defined in the joint, wherein each joint further has a bottom plate and two opposite wings formed on and protruding from the bottom plate and each wing having an outer edge, and the assembling slot of each joint is defined between the wings;

multiple frames being U-shaped and hollow and classified into a stationary frame, a supporting frame and at least one pivoting frame; the stationary frame paralleling the bottom plates of the joints and having a pair of mounting ends mounted respectively in the assembling slots of the joints; the supporting frame located near the stationary frame and having an axial hole defined in the supporting frame and a pair of pivoting ends pivotally mounted respectively in the assembling slots of the joints; the at least one pivoting frame having a pair of connecting ends pivotally mounted respectively in the assembling slots of the joints; wherein the supporting frame and the at least one pivoting frame pivot away from the stationary frame at intervals to form a parking space between the stationary frame, the supporting frame and the at least one pivoting frame; and a fly covering the stationary frame, the supporting frame and the at least one pivoting frame, enclosing the parking space and having an inner surface and two opposite end edges;

wherein each outer edge of each wing of each joint is convex, two positioning slots are formed respectively on the outer edges of the wings;

wherein each pivoting end of the supporting frame has a pivot pin mounted through the pivoting end of the supporting frame and extending through the wings of one joint;

two elongated slots being diametrically opposed, defined radially through the supporting frame near the pivoting end and communicating with the axial hole;

a locking pin mounted slidably through the elongated slots and selectively engaging the positioning slots of one joint;

a lock release mounted slidably around the supporting frame over the elongated slots and connected to the locking pin; and a spring mounted between the pivot pin and the locking pin;

wherein the pair of the mounting ends of the stationary frame, the pair of the pivoting ends of the supporting frame and the pair of the connecting ends of the at least one pivoting frame are located at different levels relative to the joints and are located by one over another;

wherein the lock release has a handling tab formed on and protruding from the lock release;

wherein the spring has two hooks hooking respectively on the locking pin and the pivot pin;

wherein the tent further comprises at least one clamp assembly and each clamp assembly has a sleeve mounted slidably around one of the stationary frame, the supporting frame and the at least one pivoting frame;

a telescopic bar mounted on the sleeve and having an inner tube mounted securely on the sleeve; and an outer tube mounted slidably around the inner tube;

a clamp mounted on the outer tube and having a stationary clamping member mounted securely on the outer tube and having a fastening hole defined through the stationary clamping member; and an inside friction pad mounted on the stationary clamping member;

a pivoting clamping member mounted pivotally on the stationary clamping member to define a clamping hole therebetween and the pivoting clamping member having a fastening slot defined through the pivoting clamping member; and an inside friction pad mounted on the pivoting clamping member;

a bolt extending through the fastening hole and the fastening slot and having two ends and a stopper formed on one end of the bolt and abutting the stationary clamping member;

a locking tab mounted between the stationary clamping member and the pivoting clamping member, mounted around the bolt and having a locking hole defined through the locking tab;

a nut screwed on the bolt and abutting the locking tab; and a knob screwed on the bolt, abutting the pivoting clamping member and having a locking bore defined through the knob and corresponding to the locking hole of the locking tab.

2. The tent as claimed in claim 1 further comprising four loop assemblies mounted respectively on the bottom plates of the joints, the stationary frame and the pivoting frame that is farthest away from the stationary frame, wherein each loop assembly has a cushion pad mounted securely on one of the bottom plates of the joints, the stationary frame and the pivoting frame, and having a first loop mounted on the cushion pad; and a board detachably contacting the cushion pad and having two opposite side tabs foamed on the board and each side tab having a fastening hole defined through the side tab; and a second loop mounted on the board and spaced from the first loop.

3. The tent as claimed in claim 2, wherein each of the stationary frame, the supporting frame and the at least one pivoting frame is a telescopic configuration and further has two extension tubes and each extending tube being hollow and having a through hole defined axially in the extension tube;

a guide slot defined radially in the extension tube and communicating with the through hole; and multiple positioning bores defined radially through the extension tube and arranged longitudinally; and a U-shaped tube being hollow and having two ends;

two transverse bores defined respectively through the ends of the U-shaped tube;

two guides mounted respectively on the ends and mounted respectively slidably in the through holes of the extension tubes and each guide having a guiding rib formed on and protruding radially on the guide and mounted slidably in the guide slot of one extension tube; and two resilient elements mounted respectively in the ends of the U-shaped tube and each resilient element having a locking protrusion mounted on the resilient element, extending through the transverse bore of one end of the U-shaped tube and retractably extending through one positioning bore of one extension tube.

4. The tent as claimed in claim 3, wherein the fly further has two first fastening assemblies mounted respectively on the end edges of the fly and each first fastening assembly having a first hook fastening member and a first loop fastening member attached to the end edge at an interval, wherein setting each end edge of the fly around the stationary frame or the pivoting frame and engaging the first hook fastening member and first loop fastening member together securely mount the end edge on the stationary frame or the pivoting frame; and multiple second fastening assemblies mounted on the inner surface of the fly and each second fastening assembly having a second hook fastening member and a second loop fastening member mounted on the inner surface, mounted around one of the at least one pivoting frames and engaging each other to position the fly on the at least one pivoting frames.

* * * * *